US010784558B2

(12) United States Patent
Liu et al.

(10) Patent No.: US 10,784,558 B2
(45) Date of Patent: Sep. 22, 2020

(54) SMALL TYPE HIGH GAIN INDOOR YAGI ANTENNA

(71) Applicant: Jiangxi Innovation and Technology Co., Ltd., Ji'an, Jiangxi (CN)

(72) Inventors: Xiaobing Liu, Jiangxi (CN); Qin Li, Jiangxi (CN)

(73) Assignee: JIANGXI INNOVATION AND TECHNOLOGY CO., LTD., Ji'an (CN)

( * ) Notice: Subject to any disclaimer, the term of this patent is extended or adjusted under 35 U.S.C. 154(b) by 42 days.

(21) Appl. No.: 16/198,755

(22) Filed: Nov. 21, 2018

(65) Prior Publication Data

US 2019/0393582 A1 Dec. 26, 2019

(30) Foreign Application Priority Data

Jun. 23, 2018 (CN) ..... 2018 1 0655028

(51) Int. Cl.

| | |
|---|---|
| ***H01Q 1/12*** | (2006.01) |
| ***H01Q 1/00*** | (2006.01) |
| ***H01Q 9/16*** | (2006.01) |
| ***H01Q 19/06*** | (2006.01) |

(52) U.S. Cl.

CPC ..... *H01Q 1/007* (2013.01); *H01Q 1/12* (2013.01); *H01Q 9/16* (2013.01); *H01Q 19/06* (2013.01)

(58) Field of Classification Search

CPC ..... H01Q 1/007; H01Q 1/12; H01Q 9/16; H01Q 19/06

See application file for complete search history.

(56) References Cited

U.S. PATENT DOCUMENTS 4,028,709 A * 6/1977 Berkowitz ..... H01Q 1/1228 343/819
4,355,315 A * 10/1982 Zoulek ..... H01Q 11/10 343/792.5
2007/0229386 A1* 10/2007 Mertel ..... H01Q 3/12 343/823

OTHER PUBLICATIONS

Derwent 2018-10955X, Chen et al.*
Derwent 2018-41420P, Geng et al.*

* cited by examiner

*Primary Examiner* — Hoang V Nguyen

(57) ABSTRACT

An indoor Yagi antenna includes an antenna body, a PCB substrate and an antenna bracket. The antenna body includes an upper shell and a lower shell which form an inner cavity containing the PCB substrate including an end connected to a signal director, an end connected to a signal reflector, a middle section connected to a main antenna oscillator, the portions of the three which are electrically contacted with the PCB substrate respectively, are wrapped by the upper shell and the lower shell, the bottom surface of the lower shell is provided with a feed line terminal block connected to the PCB substrate; the antenna bracket includes a bracket rod that can be flexibly bent, the top end of the bracket rod is provided with a universal adjusting mechanism connected to the lower shell, and the bottom end of the bracket rod is provided with a bracket base.

4 Claims, 3 Drawing Sheets

SMALL TYPE HIGH GAIN INDOOR YAGI ANTENNA

CROSS-REFERENCE TO RELATED APPLICATION

This application claims priority to Chinese patent application No. 201810655028.7 filed on Jun. 23, 2018, the contents of which are incorporated herein by reference in their entirety.

TECHNICAL FIELD

The present invention belongs to the field of communication technology, and specifically relates to a small type high gain indoor Yagi antenna suitable for indoor installation and use.

TECHNICAL BACKGROUND

Due to the large size of a traditional high-gain TV Yagi antenna, the installation thereof requires a specific antenna bracket and a specific embracing rod, meanwhile, due to the directional characteristic of the Yagi antenna, it is extremely inconvenient to adjust the orientation and the angle of the antenna after installation. In addition, due to the size and shape thereof, a user can only choose to mount the antenna in an outdoor location such as a top floor of a building, an outdoor environment and various weather factors cause the use time and service life of the Yagi antenna to be greatly reduced.

SUMMARY

In order to overcome the problem in the prior art and provide a TV antenna solution suitable for indoor installation and use, the present invention proposes a small type high gain indoor Yagi antenna, and is specifically realized by the following technical means: the small type high gain indoor Yagi antenna includes an antenna body, a PCB substrate and an antenna bracket. where the antenna body includes an upper shell and a lower shell which are fastened to each other, the upper shell and the lower shell are sealed together to form an inner cavity containing the PCB substrate, the PCB substrate is in a long-strip shape and includes a PCB Barron and a high gain amplifier, one end of the PCB substrate is connected to a signal director, and the other end thereof is connected to a signal reflector, a middle section thereof is connected to a main antenna oscillator, the portions of the signal director, the signal reflector and the main antenna oscillator, which are electrically contacted with the PCB substrate respectively, are wrapped by the upper shell and the lower shell, the bottom surface of the lower shell is provided with a feed line terminal block, the feed line terminal block is connected to the PCB substrate; the antenna bracket includes a bracket rod that can be flexibly bent, the top end of the bracket rod is provided with a universal adjusting mechanism connected to the lower shell, and the orientation of the antenna body is adjusted by the bracket rod and the universal adjusting mechanism, the bottom end of the bracket rod is provided with a bracket base standing on an attachment surface.

Compared with the prior art, the present invention has the following advantages: by reducing the number and size of the oscillators and by cooperating with the high-efficiency PCB Barron and the high gain amplifier, the performance of the antenna can reach the standard, therefore, the present invention can meet a user's requirements only by being mounted indoors, the upper shell and the lower shell of the antenna are used to seal the PCB substrate, which not only protects the high gain amplifier and other inner elements, but also facilitates the present invention more beautiful than the traditional Yagi antenna, the present invention is fixed and used by cooperating the antenna body with a detachable and adjustable bracket of the suction disk, the suction disk of the bracket discharges air by pressing downwards the lock catch, a vacuum state between the suction disk and a mounting plane facilitates the suction disk to be adsorbed on the mounting plane, the inner portion of the bracket rod of the antenna is supported by soft aluminum, when a certain force is applied to the soft aluminum, the angle thereof can be arbitrarily changed so that the antenna can be mounted at any angle, in addition, the orientation of the antenna is adjusted to loosen or tighten the adjusting nut so that the antenna can be fixed and used after turning at any angle within 360 degrees, thereby solving the use problem of the directional characteristic of the Yagi antenna.

DETAILED DESCRIPTION

Figure 1:
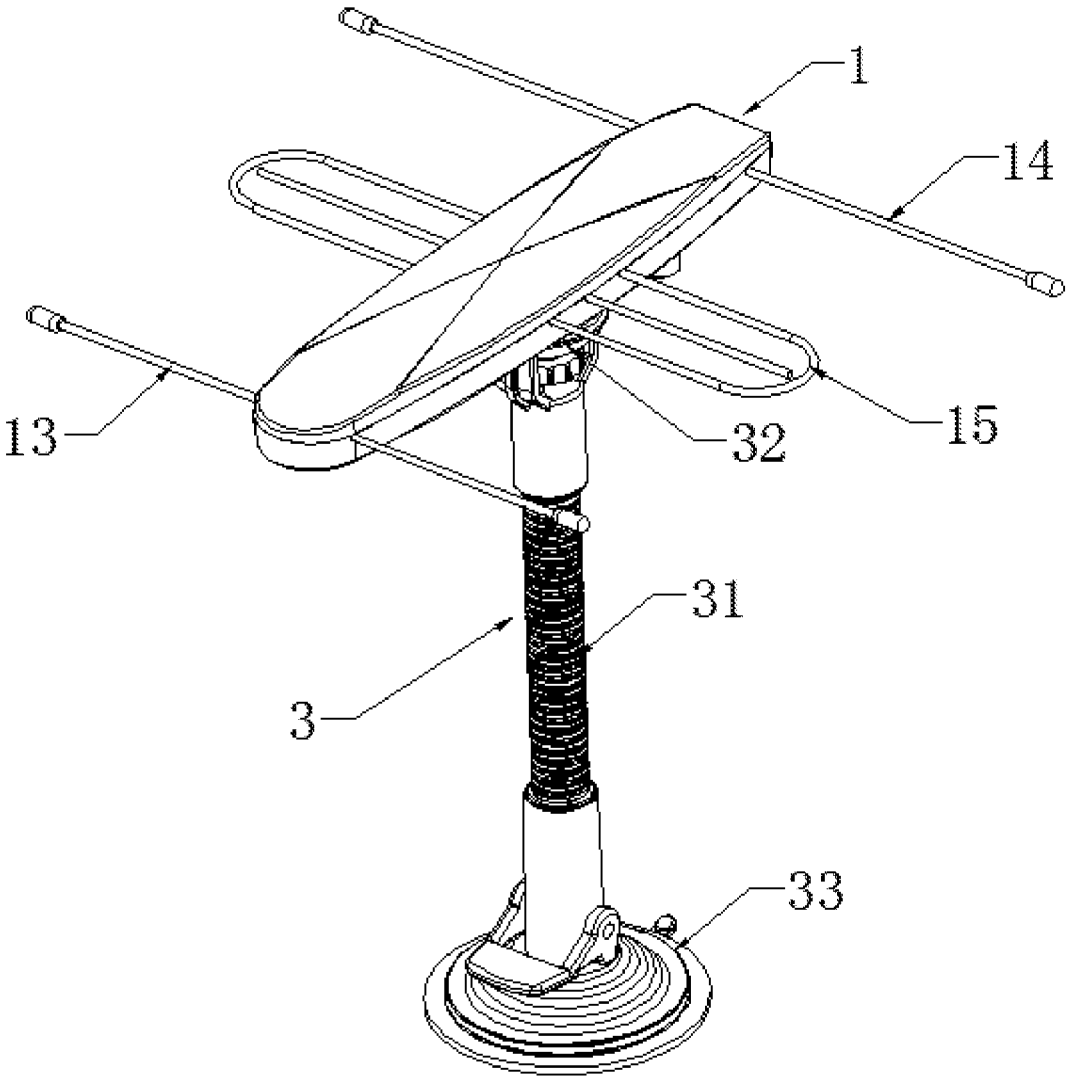
FIG. 1 is a perspective structural view of a small type high gain indoor Yagi antenna of the present invention.
Figure 2:
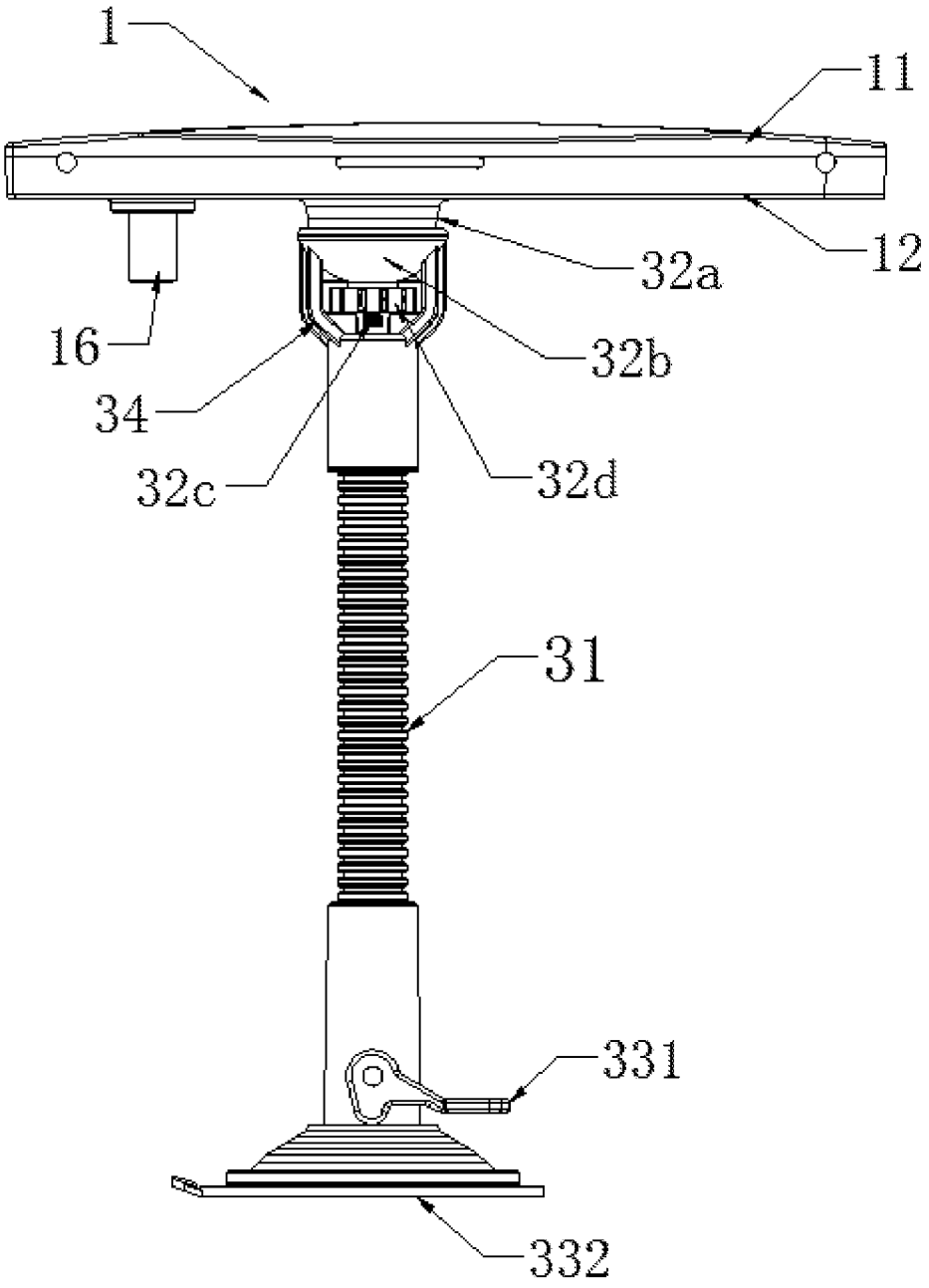
FIG. 2 is a side structural view of a small type high gain indoor Yagi antenna of the present invention.
Figure 3:
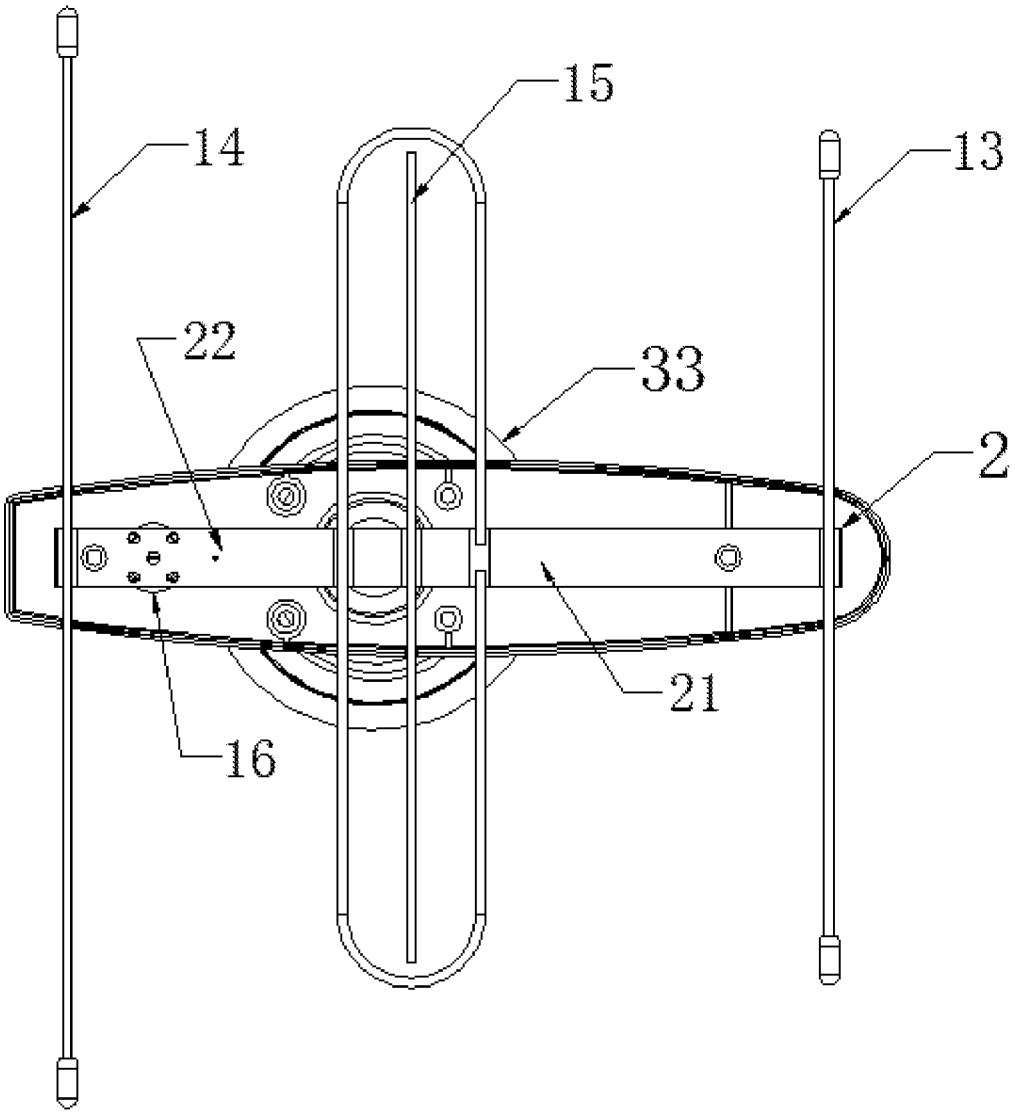
FIG. 3 is a top structural view of a small type high gain indoor Yagi antenna of the present invention (an upper shell is omitted).

The solution of the present application is further described below in conjunction with FIGS. 1 to 3:

A small type high gain indoor Yagi antenna includes an antenna body 1, a PCB substrate 2 and an antenna bracket 3, the antenna body 1 includes an upper shell 11 and a lower shell 12 which are fastened to each other, the upper shell 11 and the lower shell 12 are sealed together to form an inner cavity containing the PCB substrate 2, the PCB substrate 2 is in a long-strip shape and includes a PCB Barron 21 and a high gain amplifier 22, one end of the PCB substrate 2 is connected to a signal director 13, and the other end thereof is connected to a signal reflector 14, a middle section thereof is connected to a main antenna oscillator 15, the signal director 13, the signal reflector 14 and the main antenna oscillator 15 are extended from the upper shell and lower shell, the portions of the signal director 13, the signal reflector 14 and the main antenna oscillator 15, which are electrically contacted with the PCB substrate 2, are wrapped by the upper shell 11 and the lower shell 12, the bottom surface of the lower shell 12 is provided with a feed line terminal block 16, the feed line terminal block 16 is connected to the PCB substrate 2; the antenna bracket 3 includes a bracket rod 31 that can be flexibly bent, the top end of the bracket rod 31 is provided with a universal adjusting mechanism 32 connected to the lower shell 12, the orientation of the antenna body 1 is adjusted by the bracket rod 31 and the universal adjusting mechanism 32, the bottom end of the bracket rod 31 is provided with a bracket base 33 standing on an attachment surface. Specifically, the bracket base 33 includes a suction disk 332 with a lock catch 331, the bracket rod 31 is a metal setting tube, the universal adjusting mechanism 32 includes a universal ball 32*a*, a universal ball tray 32*b*, an adjusting screw 32*c* and an adjusting nut 32*d*, the universal ball 32*a* is mounted in an inner cavity of the universal ball tray 32*b*, the inner cavity of the universal ball tray 32*b* has a concave spherical surface cooperated with the universal ball 32*a*, the universal ball 32*a* and the concave spherical surface are rotatably cooperated, the universal ball tray 32*b* is connected to the end of the bracket rod 31 via a plurality of curved arms 34, and the adjusting nut 32*d* is placed therebetween, the suction disk 332 discharges air by pressing downwards the lock catch 331, a vacuum state between the suction disk 332 and a mounting plane (an attachment surface) facilitates the suction disk to be adsorbed on the mounting plane, the inner portion of the bracket rod of the antenna is supported by soft aluminum, when a certain force is applied to the soft aluminum, the angle thereof can be arbitrarily changed so that the antenna can be mounted at any angle, in addition, the orientation of the antenna is adjusted to loosen or tighten the adjusting nut so that the antenna can be fixed and used after turning at any angle within 360 degrees, thereby solving the use problem of the directional characteristic of the Yagi antenna; the PCB Barron 21 is arranged between the main antenna oscillator 15 and the signal director 13, the high gain amplifier 22 is arranged between the main antenna oscillator 15 and the signal reflector 14, by reducing the size of the signal director 13, the signal reflector 14 and the main antenna oscillator 15 (for example, the length of the signal director 13 is 174 mm, the length of the signal reflector 14 is 224 mm and the length of the main antenna oscillator 15 is 165 mm), and by cooperating with the high efficiency PCB Barron 21 and the high gain amplifier 22, the performance of the antenna reaches the standard, thereby meeting the requirements of signal reception and indoor installation, The above-mentioned preferred embodiments are to be considered as illustrative of the embodiments of the present application. Any identity and similarity with the present application or technical derivations, substitutions, improvements, etc., which are made based on the same, should be regarded as the protection scope of the present patent.

What is claimed is:

1. A small type high gain indoor Yagi antenna, comprising an antenna body, a PCB substrate and an antenna bracket, wherein the antenna body comprises an upper shell and a lower shell which are fastened to each other, the upper shell and the lower shell are sealed together to form an inner cavity containing the PCB substrate, the PCB substrate is in a long-strip shape and comprises a PCB Barron and a high gain amplifier, one end of the PCB substrate is connected to a signal director, and the other end thereof is connected to a signal reflector, a middle section thereof and the main antenna oscillator, one end of the PCB substrate is connected to a signal director, and the other end thereof is connected to a signal reflector, a middle section thereof is connected to a main antenna oscillator, the portions of the signal director, the signal reflector and the main antenna oscillator, which are electrically contacted with the PCB substrate respectively, are wrapped by the upper shell and the lower shell, the bottom surface of the lower shell is provided with a feed line terminal block, the feed line terminal block is connected to the PCB substrate; the antenna bracket comprises a bracket rod that can be flexibly bent, the top end of the bracket rod is provided with a universal adjusting mechanism connected to the lower shell, the orientation of antenna body is adjusted by the bracket rod and the universal adjusting mechanism, and the bottom end of the bracket rod is provided with a bracket base standing on an attachment surface; the PCB Barron is arranged between the main antenna oscillator and the signal director, and the high gain amplifier is arranged between the main antenna oscillator and the signal reflector.

2. The small type high gain indoor Yagi antenna according to claim 1, wherein the bracket base comprises a suction disk with a lock catch.

3. The small type high gain indoor Yagi antenna according to claim 1, wherein the bracket rod is a metal setting tube.

4. The small type high gain indoor Yagi antenna according to claim 1, wherein the universal adjusting mechanism comprise a universal ball, a universal ball tray, an adjusting screw and an adjusting nut, the universal ball is mounted in an inner cavity of the universal ball tray, the inner cavity of the universal tray has a concave spherical surface cooperated with the universal ball, the universal ball and the concave spherical surface are rotatably cooperated, the universal ball tray is connected to the end of the bracket rod via a plurality of curved arms, and the adjusting nut is placed therebetween.

* * * * *